United States Patent [19]

Kakuk et al.

[11] Patent Number: 4,774,648

[45] Date of Patent: Sep. 27, 1988

[54] LOW VOLTAGE LIGHT FIXTURE

[75] Inventors: Jay J. Kakuk, Plymouth; Bart T. Ellson, Chanhassen; Robert W. Beachy, St. Paul, all of Minn.

[73] Assignee: The Toro Company, Minneapolis, Minn.

[21] Appl. No.: 50,842

[22] Filed: May 15, 1987

[51] Int. Cl.[4] ..... F21V 7/00

[52] U.S. Cl. ..... 362/302; 362/431; 248/530; 439/426

[58] Field of Search ..... 362/431, 368, 302, 303, 362/290, 291; 248/545, 530, 156; 439/391, 395, 426

[56] References Cited

U.S. PATENT DOCUMENTS

| | | | |
|---|---|---|---|
| 1,757,975 | 5/1930 | Perkins | 362/337 |
| 1,952,789 | 3/1934 | Butts | 248/156 |
| 2,554,584 | 5/1951 | Metz | 362/335 |
| 2,564,065 | 8/1951 | Jaden | 248/156 |
| 2,797,310 | 6/1957 | Moore | 362/431 |
| 3,015,720 | 1/1962 | Silverman | 362/431 |
| 3,369,115 | 2/1968 | Yonkers | 362/217 |
| 3,593,014 | 7/1971 | Vesely | 362/431 |
| 4,164,094 | 8/1979 | Kempka | 248/545 |
| 4,626,974 | 12/1986 | Dean | 362/396 |

FOREIGN PATENT DOCUMENTS

| | | | |
|---|---|---|---|
| 974353 | 11/1960 | Fed. Rep. of Germany | 362/431 |
| 296562 | 9/1928 | United Kingdom | 248/156 |

OTHER PUBLICATIONS

Two leaflets labelled "LIGHT I."; 5/1986.
Two sheets labelled "LIGHT II."; on sale 5/1986.

*Primary Examiner*—Charles J. Myhre
*Assistant Examiner*—David A. Okonsky
*Attorney, Agent, or Firm*—R. Lawrence Buckley

[57] ABSTRACT

A low voltage light fixture (10) including a bulb/lens assembly (12) mounted atop an integral post/stake assembly (14). Post/stake assembly (14) includes a hollow tubular portion (20) and a ground stake portion (22). A preferred post/stake assembly (14) is formed from a single piece of plastic, and consists of a pair of elongate legs (94, 96) which are joined to a female adapter (90) through the use of a pair of "living hinges" (100). To assemble post/stake assembly (14), it is merely necessary to draw legs (94, 96) together until a pair of locking fingers (104) extending from leg (94) engage a pair of slots (110) formed in the other leg (96). Light fixture (10) also preferably includes a unique internally ribbed lens which includes a large plurality of internal side ridges (114) and a smaller plurality of top ridges (116). An improved light fixture (10) also preferably includes a pair of integral bulb contact/prong elements (84) and provides for aesthetic customization by allowing the selective removal of one of the louvres (32).

1 Claim, 4 Drawing Sheets

LOW VOLTAGE LIGHT FIXTURE

TECHNICAL FIELD

The invention relates generally to light fixtures, and more particularly to low voltage light fixtures which include ground stakes, lenses, and lens louvres.

BACKGROUND OF THE INVENTION

Low voltage lighting systems are well known. Such systems include a power supply which provides a voltage substantially lower than 110 volts AC, e.g., 12 volts AC. Not only are such low voltage systems safer, they can also be installed by the average homeowner.

Low voltage lighting systems generally include four basic components, as follows: (i) a transformer or power pack for converting 110 volts AC to 12 volts AC (for example); (ii) a control system consisting of a timer and/or photoelectric cell, and optionally a manual on/-off switch; (iii) a plurality of light fixtures suitable for mechanical connection to a "ground surface" through the use of a stake or mounting plate, for example; and (iv) a cable for electrically interconnecting the components described above. The present invention is particularly directed toward a low voltage light fixture suitable for use in such low voltage lighting systems.

Low voltage light fixtures preferably include several features. For one thing, even though they are operated at a comparatively low voltage, they should provide adequate light for their intended purpose. The light should be well diffused by a lens or baffle so that "hot spots" are avoided. Hot spots, as that term is used herein, are bright concentrations of light which occur when the fixture's lens or light baffle does not provide a well diffused light but instead provides a light which is much more concentrated in the immediate vicinity of the bulb or tube.

Another desirable feature of low voltage lighting fixtures is that they provide light at the proper height so that landscaping or architectural details can best be illuminated. There are two particularly popular types of low voltage light fixtures, i.e. floodlights and temple lights. Floodlights, or spotlights, provide a fairly narrow, concentrated beam, whereas temple fixtures emanate light outward and downward through the use of louvres. This results in a cone of light having an apex at the top of the fixture and a base on the ground surface. Temple light fixtures must therefore be positioned adjacent to or above the subjects to be illuminated. Thus, for example, it may be desirable to have the temple light immediately above the ground surface to delimit and illuminate a walkway. It may also be desirable to have the temple light located at some preselected distance above the ground plane so that plants and various architectural features can be highlighted.

Of course, in addition to providing the maximum light output available (without hot spots) and being positionable at various heights, low voltage lighting fixtures must also be safe and reliable. Thus, the cable which connects the light fixtures to the transformer should preferably be buried or otherwise encased or enclosed so as to minimize the risk of damaging the cable during lawn mowing or trimming operations, for example.

Low voltage light fixtures must be attractive as well. One of their primary functions is to enhance the attractiveness of homes and businesses; if the lights themselves are unattractive or aesthetically incompatible with the grounds or architecture, the lights will be unacceptable to purchasers and will not fulfill their intended function. In view of the wide variety of tastes and styles, the Applicants believe that low voltage light fixtures should preferably be modular or convertible so that they can be modified to suit the purpose at hand.

Low voltage light fixtures should also be relatively inexpensive; have relatively few parts; and be simple to assemble.

Unfortunately, prior art low voltage lighting fixtures do not possess all of the desirable features discussed above. One type of low voltage lighting fixture, shown in FIG. 1, includes a simple ground stake and a bulb/lens assembly including a translucent lens surrounding an incandescent bulb. The ground stake is typically approximately seven to eight inches long. It tapers to a sharp point and has a "+" or X-shaped cross section. The upper end of the ground stake forms a forked female adapter suitable for slideably receiving a male adapter located at the bottom of the bulb/lens assembly. The cable simply loops over the top of the ground stake, between the upwardly extending tines of the female adapter and beneath the male adapter of the bulb/lens assembly, and small metal prongs (see FIG. 2) depending from the bulb/lens assembly penetrate the cable insulation so as to place the light source (e.g., incandescent bulb) in electrical contact with the conductor. Still referring to the prior art design of FIG. 1, the bulb/lens assembly basically includes a lens surrounding an incandescent bulb, and a plurality of vertically spaced louvres or baffles for directing the light downward. The lens is made of plastic having uniform thickness and translucence over the entire surface thereof. The louvres are fixed and separated by three spanners spaced at 120° intervals around the outer periphery of the lens.

While the light fixture shown in FIG. 1 has proven to be an excellent design, both from aesthetic and safety standpoints, it is perceived that the design can be improved. For example, even though the cable is only exposed for a very short distance, the cable is still not totally enclosed or encased. It is thus partially exposed to the elements and to mowers, weed trimmers and the like. This problem is particularly troublesome when the ground stake is only partially inserted into the ground in an attempt to elevate the light source to a preferred height above the ground.

The type of light fixture shown in FIG. 1 is also disadvantageous because it includes a simple translucent lens of the type which either provides insufficient light output because it is excessively opaque in order to fully diffuse the light, or has "hot spots" because the lens is quite transparent in an attempt to provide the maximum amount of light power. Also, the louvre spanners diminish the net light power provided by the fixture. Finally, the temple light fixture is not modular or convertible in the sense that the louvres can be removed or adjusted to variably provide a "look" consistent with the surrounding architecture of landscape.

In an attempt to solve the exposed cable problem, and to allow the user to position the light source at a preferred height above the ground surface, a "post" was added to the basic ground stake design shown in FIG. 1. FIG. 2 illustrates this improved prior art light fixture. It includes a ground stake suitable for insertion in the ground and an upper male end suitable for insertion into the lower end of a hollow post. A female adapter (functionally analogous to the upper end of the traditional stake shown in FIG. 1) inserts into the top end of the post and a bulb/lens assembly identical to that shown in FIG. 1 slideably connects with the forked female adapter. The cable is therefore substantially encased or enclosed and is insulated from the elements and less likely to be inadvertently damaged. It should be noted that the lower end of the bulb/lens assembly is broken away in FIG. 2 to show one of the small metal cable-puncturing prongs.

While the fixture of FIG. 2 is an improvement over that of FIG. 1 in that the cable is better protected and the light source can be raised to about 18 inches off the ground, the FIG. 2 design still suffers from some disadvantages. One problem is that the light fixture shown in FIG. 2 includes four basic components, the light source or lens/bulb assembly; female adapter; post; and stake. Given the fact that the light source itself includes a plurality of louvres, a lens, and various other components, the design shown in FIG. 2 is relatively costly, primarily due to the number of parts which must be manufactured and stocked. Also, each light fixture requires significant assembly due to the number of parts. To assemble the fixture shown in FIG. 2, there must first be sufficient slack in the cable to insert it through the hollow post and up and over the female adapter. The female adapter is then inserted into the top of the post and the excess cable pulled down through the post. Then, the stake can be inserted into the lower end of the post and the male adapter of the bulb/lens assembly slid into operative contact with the female adapter. Thus, there are several parts to assemble, and considerable extra cable must be available to interconnect an entire string of fixtures.

Another problem with the fixture shown in FIG. 2, and other prior art fixtures, is that the cable-piercing prongs are separate from the bulb socket assembly, with wires running therebetween. In such prior art fixtures, the bulb socket is mechanically connected to the lower louvre assembly. Two wires extend downward from the bulb socket and terminate in wire lugs, which in turn removably attach to the cable prongs. A sectional view of this somewhat cumbersome design is shown in FIG. 10.

Finally, the light fixture shown in FIG. 2 still has efficiency and hot spot problems attributable to the lens and louvre spanner designs and is incapable of being modified or converted to fit various architectural styles.

The present invention addresses the problems associated with prior art low voltage lighting fixtures. In particular, in preferred embodiments the light fixture of the present invention provides a significant amount of light without the nuisance of hot spots. Also, preferred embodiments include an integral stake/post adapter component which is manufactured in a "living hinge" configuration. This results in an inexpensive light fixture which is easy to assemble. Preferred light fixtures according to the invention are also flexible in terms of their aesthetics: one of the louvres can be removed to significantly change the aesthetic impact of the fixture, and to change the net amount of light provided by the light source. Finally, preferred embodiments include integral bulb contact/cable prongs which are inexpensive and reliable.

SUMMARY OF THE INVENTION

Accordingly, in a broad sense, one embodiment of the invention is a low voltage light fixture suitable for operatively holding a "light source" in spaced relation to a "ground surface," including:

(a) means for operatively supporting the light source;

(b) means for attaching the fixture to the ground surface; and (c) elongate post means for spanning between the light source supporting means and the ground surface attaching means, wherein the attaching means and post means comprise longitudinally-split elongate legs which are hingedly joined to the light source supporting means.

The "attaching means" referred to above can include a ground stake. Also, the "attaching means," "supporting means" and "post means" are preferably integrally formed from a single piece of plastic such that the elongate legs referred to above are hingedly joined to the supporting means in "living hinge" fashion.

The "light source" can be a bulb/lens assembly including means for holding an incandescent bulb and a lens surrounding such bulb holding means. The bulb is preferably supported by a pair of integral cable prong-/bulb contact elements which eliminate many of the parts used in prior art designs.

The invention also includes a unique lens design. The lens is preferably substantially cylindrical with a conical lens top, wherein the side wall of the cylindrical portion forms a plurality of side ridges and the lens top similarly forms a plurality of top ridges. The side ridges and top ridges are preferably internal, proximate the light source, e.g., incandescent bulb. Further, the side ridges are preferably substantially parallel to the lens longitudinal center line, and the top ridges preferably extend radially outward from the lens longitudinal center line to the lens side wall.

In a preferred lens embodiment, there are twice as many side ridges as there are top ridges. For example, there can be 144 side ridges (on two and one-half degree centers) and 72 top ridges (on five degree centers). In cross section, the side and top ridges are preferably right isosceles triangles, wherein the hypotenuse side of each ridge is tangent the side wall or lens top and the right angle is radially inward in relation to the hypotenuse side. A preferred height for the side ridges is about 0.025 inch along its entire length, and wherein each top ridge has a preferred height of about 0.025 inch at the lens periphery. The height of the top ridges decreases toward the center line of the lens.

A preferred light fixture according to the invention also includes one or more integral elements suitable for piercing a cable and for conductively supporting a bulb.

Finally, preferred temple lights according to the invention include one or more removable louvres.

Additional aspects of the invention are described below.

BRIEF DESCRIPTION OF THE DRAWINGS

A preferred embodiment of the invention will be further described with reference to the Drawings, wherein.

DETAILED DESCRIPTION OF THE INVENTION

Figure 3:
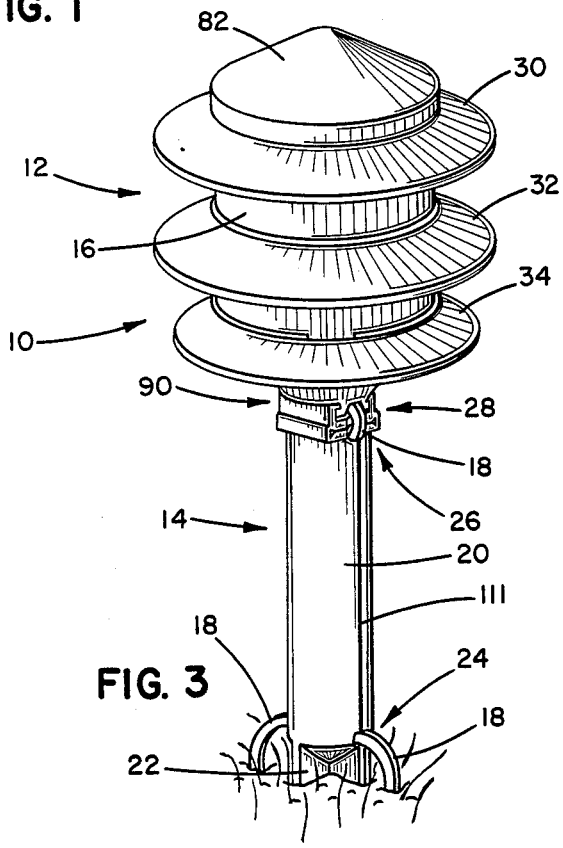
FIG. 3 is a perspective view of a low voltage light fixture according to the invention with the stake portion thereof inserted into the ground.

Referring to the Drawings, wherein like reference numerals designate like parts and assemblies throughout the several views, FIG. 3 illustrates a perspective view of a preferred light fixture 10 according to the invention, inserted into the ground. Light fixture 10 includes as its basic components a light source or bulb/lens assembly 12 situated atop a post/stake assembly 14. Bulb/lens assembly 12 includes a substantially cylindrical lens 16 which surrounds a bulb 68 (see FIG. 8); preferred lens 16 is of a unique ribbed design which will be described below. The bulb is in conductive contact with a cable 18 which in turn is connected to a low voltage (e.g., 12 volts AC) power supply (not shown). Post/stake assembly 14 consists of a hollow tube portion 20 and a stake portion 22 suitable for insertion into the ground. As shown in FIG. 3, bulb/lens assembly 12 is located a preselected distance above the ground surface, this distance being primarily determined by the length of tube portion 20. A preferred maximum height is about eight inches, measured from the ground to the midpoint of the bulb/lens assembly 12. Of course, tube portion 20 can also be partially or wholly inserted into the ground to variably bring the light source 12 to within close proximity of the ground surface.

Hollow tube portion 20 forms a pair of diametrically-opposed lower cable slots 24 and a pair of diametrically-opposed upper cable slots 26. One of the lower cable slots 24 receives cable 18 and the associated vertically-aligned upper cable slot 26 permits cable 18 to exit tube portion 20 and loop through a channel 28 for contact with sharp metal bulb contact/prongs 84 (see FIG. 7) conductively coupled to the bulb. Channel 28 is formed by a female adapter 90 atop post/stake assembly 14 and a male adapter 72 depending from bulb/lens assembly 12. Upon exiting channel 28, cable 18 threads through the other upper cable slot 26, down through tube portion 20, and finally out through the other lower cable slot 26. Cable 18 subterraneanly extends to other similar fixtures 10 and ultimately to a power pack.

Figure 8:
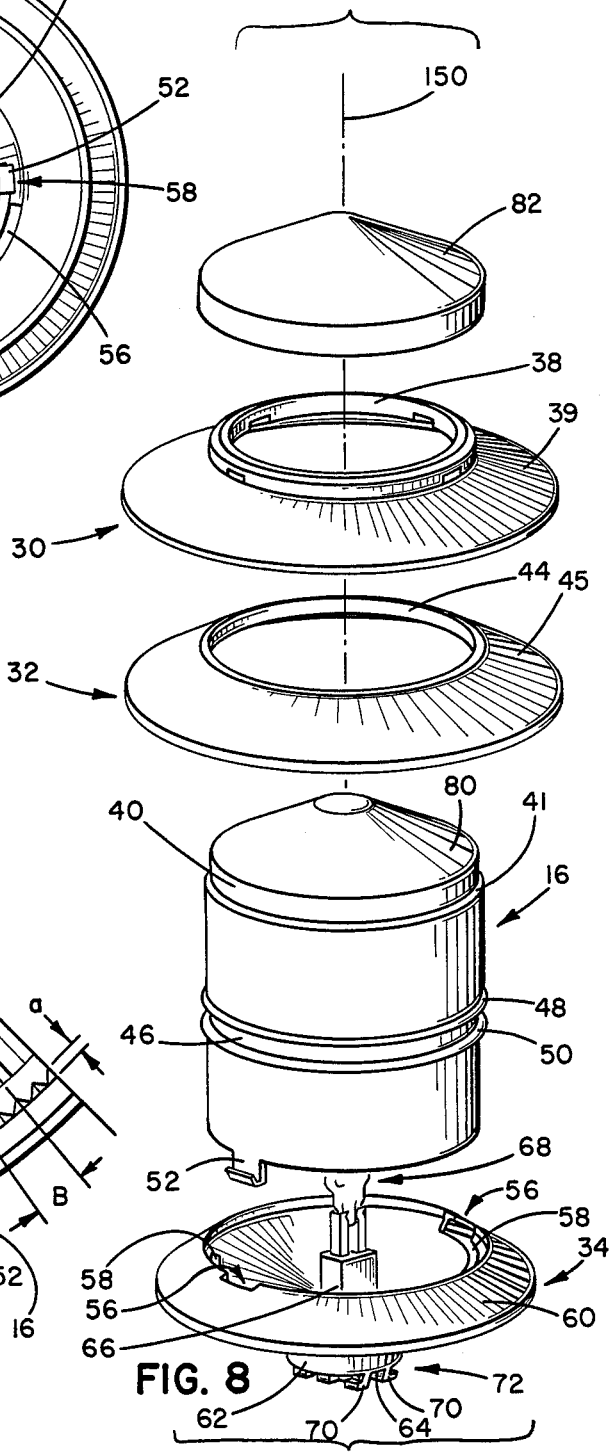
FIG. 8 is an exploded perspective view of the bulb/lens assembly portion of the light fixture of FIG. 3.
Figure 10:
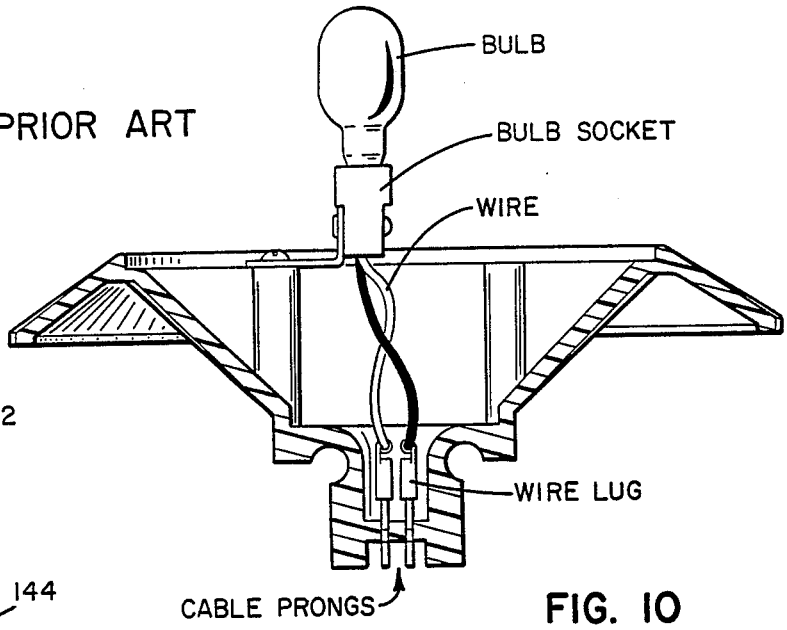
FIG. 10 is a sectional view of the lower louvre assembly of the prior art fixture of FIG. 2.

With particular reference to FIG. 8, bulb/lens assembly 12 can now be described in some detail. As discussed above, the light source 12 includes substantially cylindrical lens 16. Lens 16 has a centerline 150, and the other components of assembly 12 are coaxial with lens 16. Lens 16 preferably carries a plurality of annular frusto-conical louvres or baffles which angle downwardly from the cylindrical side wall of lens 16. In the embodiment shown in the Drawings, there is a top louvre 30, a middle louvre 32 and a bottom louvre assembly 34. Top louvre 30 includes a narrow cylindrical top louvre snap ring 38 and a depending frusto-conical skirt 39. Snap ring 38 is sized to snap onto a top louvre land 40 formed in the lens 16. Land 40 is a cylindrical portion of lens 16 which has a slightly smaller radius than the remaining portion of the lens. In fact, an annular ridge 41 is formed at the juncture between the two portions, and ridge 41 supports the undersurface of ring 38.

Middle louvre 32 includes a snap ring 44 which fits snugly about a cylindrical middle louvre land 46 formed roughly at the longitudinal midsection of the cylindrical lens 16. Land 46 is formed by a ring-like upper ridge 48 and a somewhat larger outside diameter ring-like lower ridge 50. Middle louvre 32 includes a skirt 45 and can be snapped in place or removed, depending on the desired appearance, over the smaller ridge 48.

Bottom louvre assembly 34 includes a frusto-conical downwardly-angling skirt 60 which preferably has an outside diameter somewhat smaller than the outside diameter of skirts 39 and 45. In a preferred embodiment, the diameter of skirts 39 and 45 is about 6 inches, whereas the diameter of skirt 60 is about $4\frac{7}{8}$ inches. Skirts 39, 45, 60 each form an angle with lens 16 of about 60 degrees. Skirt 60 is connected at its uppermost ring-like portion to a descending conical section 62 which narrows to form a flat 64 at its lowest point. Flat 64 supports an upwardly extending bulb pedestal 66 and a pair of downwardly and outwardly extending L-shaped legs 70, the function of which will be described below.

Figure 12:
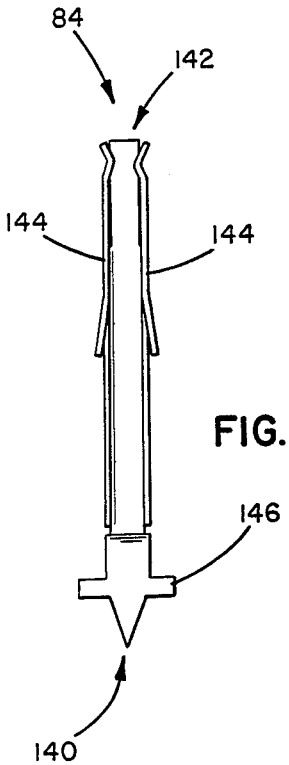
FIG. 12 is an enlarged elevational view of an integral prong/bulb support element of the lower louvre assembly shown in FIG. 11.
Figure 11:
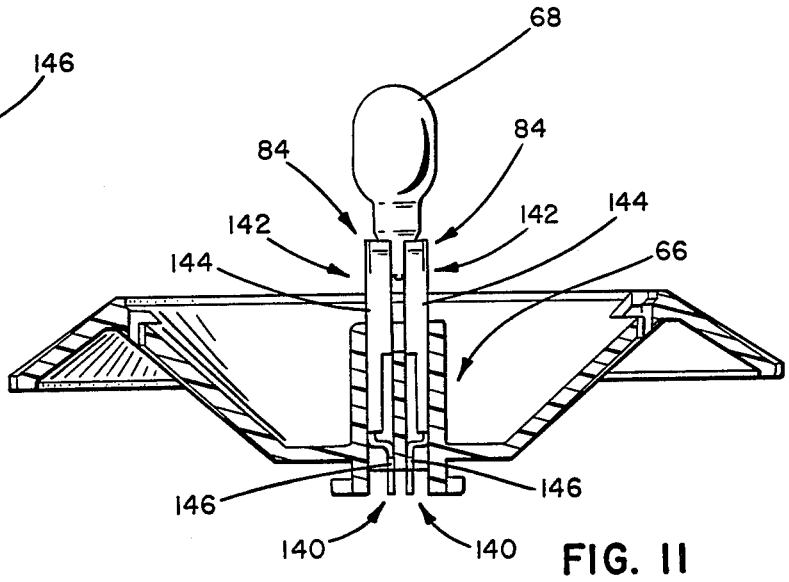
FIG. 11 is a sectional view of the lower louvre assembly of the fixture shown in FIG. 3.

Bulb pedestal 66 is in the nature of a longitudinally bifurcated tube and is sized to receive a pair of facing integral cable prong/bulb contact elements 84 suitable for holding the base of a bulb 68 and making electrical contact with the lead wires thereof. An enlarged sectional view of lower louvre assembly 34 is shown in FIG. 11. Each element 84 includes a pointed prong end 140 and a three-sided square bulb receiving end 142. As shown in FIG. 12, each bulb receiving end 142 consists of three independent leaves 144, such that one each of the contacts of bulb 68 is springingly held by the bulb receiving end of one each of the elements 84. Leaves 144 inherently hold the bulb 68 in place, as elements 84 are preferably made of resilient phosphor bronze. Facing elements 84 cooperate to support bulb 68 and engage the electrical contacts thereof. It should be noted that even the outer edges of the bulb are surrounded by the leaves 144 of elements 84; thus, the bulb leads, typically fine wires extending out of the base of the glass bulb, are engaged even if they slip around to the sides of the bulb. It should be noted that there is a pair of barbs 146 which extend outwardly and downwardly from side leaves 144. Barbs 146 hold elements 84 in place within pedestal 66.

The prong ends 140 of elements 84 protrude downwardly through lower flat 64 of conical section 62 and into channel 28 formed by the downwardly extending legs 70 and by female adapter 90. As further described below, when lower louvre assembly 34 is attached to post/stake assembly 14, the prongs 140 pierce the insulation of cable 18 to conductively couple the conductors within cable 18 and the filament within bulb 68.

Figure 7:
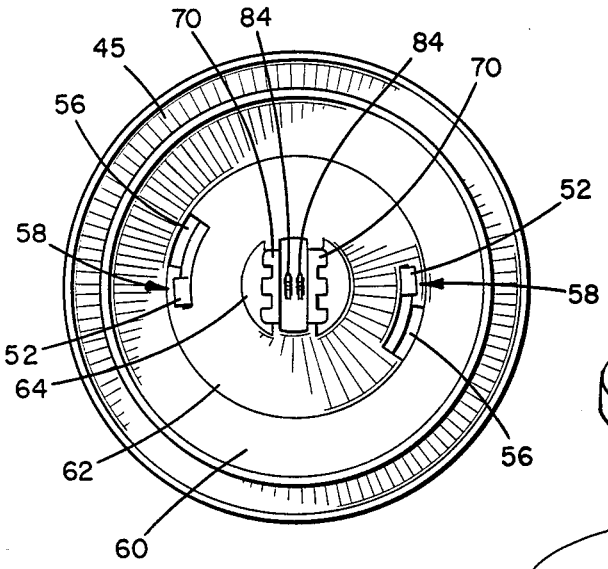
FIG. 7 is a bottom orthographic view of the bulb/lens assembly portion of the light fixture shown in FIG. 3.

Bottom louvre assembly 34 is connected at its uppermost point to the bottom portions of the lens 16. To effect this interconnection, lens 16 includes a pair of diametrically-opposed depending lens tabs 52 which extend downward from the lens 16 approximately 5/16 inch. Each tab 52 includes a vertical portion which is actually a short extension of the wall of lens 16, and a downward pointing V-shaped portion which is designed to securely grip bottom louvre assembly 34. As shown in FIG. 7, lens tabs 52 are connected to bottom louvre assembly 34 using a bayonet fitting technique. In particular, the upper edge of conical section 62 of bottom louvre assembly 34 forms a pair of diametrically-opposed tab receiving apertures 56 through which tabs 52 can be easily inserted. Extending circumferentially from each tab receiving aperture 56 is a smaller tab locking aperture 58 sized and configured to seize its associated lens tab 52. Thus, to assemble the lens 16 and bottom louvre assembly 34, lens tabs 52 are inserted through tab receiving apertures 56 and lens 16 is turned counterclockwise relative to bottom louvre assembly 34 (as viewed in FIG. 7). This causes tabs 52 to pivot out of their respective receiving apertures 56 and into their respective tab seizing apertures 58.

As noted above, lens 16 is substantially cylindrical. Lens 16 includes, however, a conical lens top 80 which extends upward from upper louvre land 40. Lens top 80, like the side wall of lens 16, includes an internal ribbing configuration which is decorative and functional, as further described below. Lens top 80 can be optionally covered with a cap 82 which is sized to snap over snap ring 38 of upper louvre 30. Thus, up lighting as well as down lighting can be achieved by simply removing cap 82.

Figure 4:
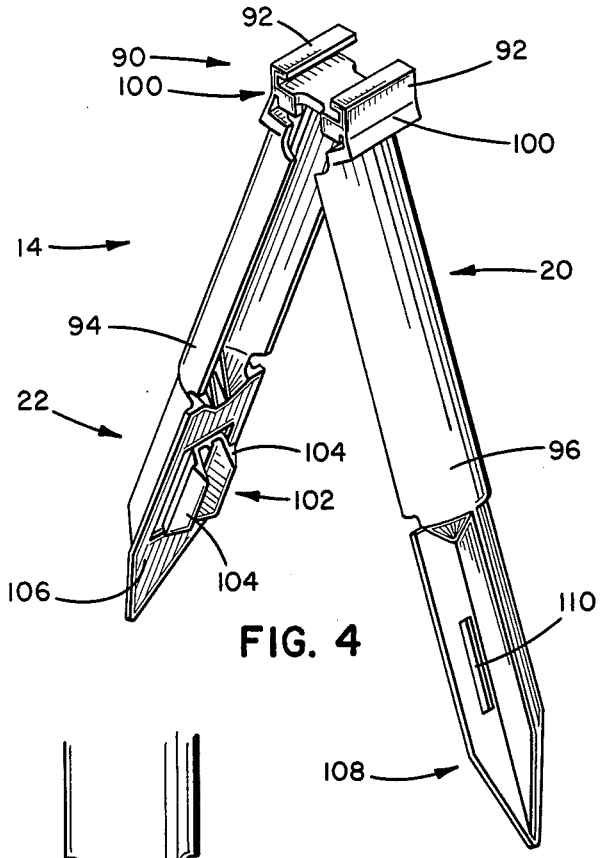
FIG. 4 is a perspective view of the post/stake portion of the light fixture of FIG. 3 with the legs split.
Figure 5:
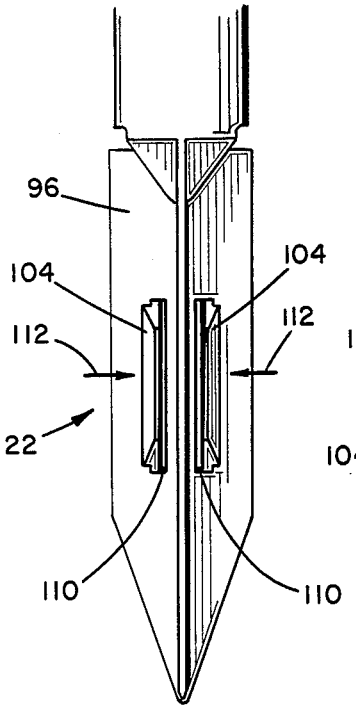
FIG. 5 is a partial front elevational view of the stake portion of the light fixture of FIG. 3.
Figure 6:
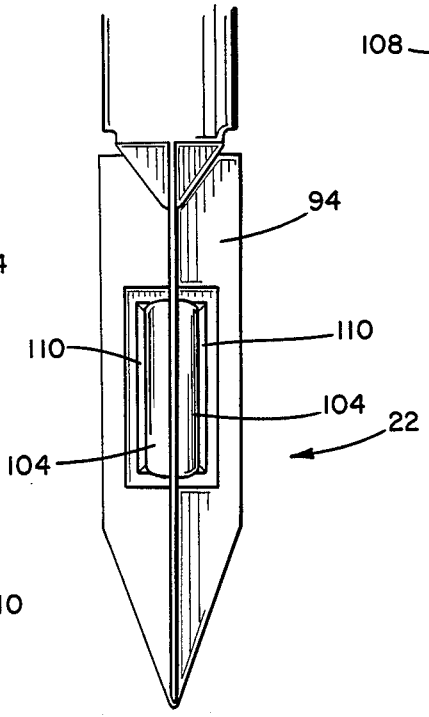
FIG. 6 is a partial rear elevational view of the stake portion of the light fixture of FIG. 3.

FIGS. 4–6 show enlarged views of a preferred post/stake assembly 14. As noted above, post/stake assembly 14 includes an upper tube portion 20 and lower stake portion 22. Atop tube section 20 a substantially U-shaped female coupler 90 which includes a pair of inwardly facing L-shaped legs 92 suitable for slideably receiving the outwardly-facing legs 70 on the lower louvre assembly 34. Female coupler assembly 90 combines with male coupler assembly 72 on the lower portion of louvre assembly 34 to form cable channel 28 suitable for receiving cable 18. When channel 28 is formed, by sliding bulb/lens assembly 12 into contact with post/stake assembly 14, metal prongs 84 pierce the insulation of cable 18 to place the filament of bulb 68 into electrical contact with the conductors within cable 18.

Post/stake assembly 14 preferably consists of a male leg 94 and a female leg 96 which are hingedly connected to female coupler portion 90 by a pair of "living hinges" 100. Living hinges 100, as well known to those skilled in the art of plastic fabrication, are simply thin webs of plastic which are sufficiently thin and durable to accommodate repeated flexing. During production, prior to complete curing of the resin, living hinges 100 are flexed to align the molecular chains normal to the hinging action. Post assembly 14 is actually molded with the legs 94, 96 completely split, 180° apart. Then, prior to complete curing of the resin, legs 94, 96 are flexed relative to the female coupler section 90, thus properly aligning the molecules within living hinges 100 to give them the proper characteristics. Preferably, post/stake assembly 14 is made from Profax 7523 polypropylene, produced by Himont Co., as are the other plastic components of light fixture 10.

Referring in particular to FIG. 4, male leg 94 of post/stake assembly 14 includes a U-shaped stake lock 102 which includes a pair of fingers 104 which are spring biased outward due to the inherent resiliency of the resin. Fingers 104 extend toward female leg 96 from a substantially planar first mating surface 106 located on the stake portion 22 of female leg 94. A second mating surface 108 is located on the stake portion 22 of female leg 96. Mating surface 108 faces mating surface 106. A pair of vertical slots 110 are formed in mating surface 108 and are sized and positioned so as to receive fingers 104 when the main legs 94, 96 of assembly 14 are drawn together. The fingers 104, as noted above, are spring-biased outward, and the outer surfaces of fingers 104 form ridges or notches which catch on the outer sides of slots 110 when fingers 104 have been sufficiently inserted into slots 110. Legs 94, 96 butt together to form an integral post/stake assembly 14 which is functionally analogous to the stake/post/female adapter assembly shown in FIG. 2. A seam 111, visible in FIG. 3, is formed at the interface between legs 94, 96. At this point, legs 94, 96 are locked together, and in order to separate them it is necessary to urge fingers 104 together to allow the catches or ridges on the outer surfaces thereof to slide past the outer edges of slots 110.

FIGS. 5 and 6 are enlarged elevational views of the stake portion 22 of post/stake assembly 14 in its assembled state. FIG. 5 shows the female leg 96, whereas FIG. 6 shows the male leg 94. FIG. 5 in particular shows how fingers 104 spring outward to catch on the outer sides or edges of slots 110. Arrows 112 indicate the directions in which fingers 104 must be moved in order to remove them from engagement with slots 110 to allow the separation of legs 94, 96 of post/stake assembly 14. Of course, once fixture 10 in assembled and installed, it should not normally be necessary to disassemble the post assembly 14. However, if disassembly is required, living hinges 100 will accommodate repeated flexing.

Figure 9:
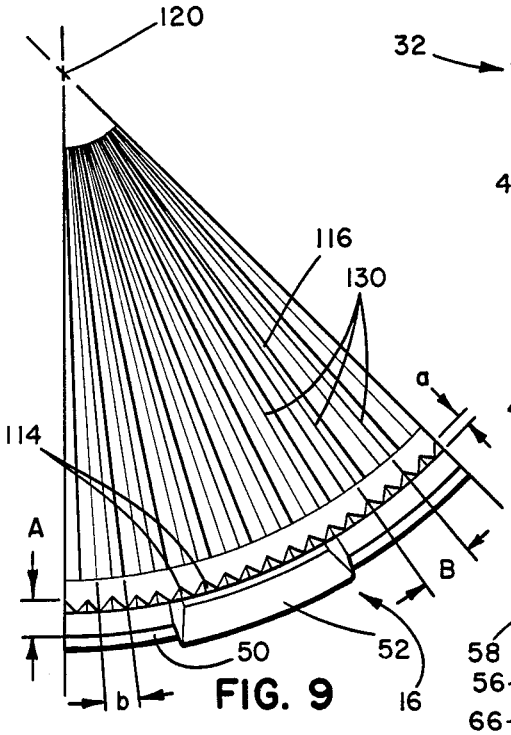
FIG. 9 is an enlarged bottom plan view, partly in section, of the lens of the light fixture shown in FIG. 3.

FIG. 9 is a partial, enlarged view of lens 16 taken from the bottom looking up toward lens top 80. As shown, lens 16 has a substantially smooth exterior but is internally ribbed. The side wall of lens 16 consists of a plurality of vertical side ridges 114 which combine to form a "sawtooth" pattern on the internal side wall surface of lens 16. The side wall of lens 16 is approximately 0.095 inch thick, this dimension being indicated in FIG. 9 with the label "a". Of this thickness, only approximately 0.025 inch is formed by the ribs 114, this dimension being designated "A" in FIG. 9. Each ridge 114 has a triangular cross section, wherein the triangle is a right isosceles triangle, and wherein the hypotenuse is tangent to the side wall and the right angle is radially inward toward the longitudinal center line 120 of the lens. For a lens 16 having an internal diameter of approximately 3 inches, there are preferably 144 ridges 114, wherein each ridge 114 occupies roughly 2½ degrees of the inner periphery of lens 16.

Lens top 80 is also internally ribbed. A plurality of inwardly and downwardly facing top ridges 116 combine to form the ribbed configuration. As shown in FIG. 9, ridges 116 are tapered such that they are widest at the outer periphery of lens 16 and narrowest toward the longitudinal center line 120 of lens 16. Each ridge 116, like the ridges 114, has a right isosceles triangular cross section. There are preferably half as many ridges in lens top 80 as there are in the side wall of lens 16. Thus, the angle between adjacent top ridges 116 is approximately 5 degrees. Also, each ridge 116 is, at its outer periphery, roughly 0.025 inch high. Each ridge 116 has a peak 130. The width of each tip ridge 116, labeled "b" in FIG. 9, is about 0.058 inch, and the distance between adjacent peaks 130, designated "B", is approximately 0.130 inch.

It should be noted that all of the plastic parts, including the post/stake assembly 14 and the lens/bulb assembly 12, with the exception of prongs 84, are injection-molded polypropylene.

To assemble light fixture 10, cable 18 is placed over the piercing points of elements 84 and pushed down, so that elements 84 come into conductive engagement with the multi-stranded wire within cable 18. Bulb/lens assembly 12 is then slid into engagement with post 14 and the legs 94, 96 of stake 14 are unfolded. Cable 18 is then routed through the legs 94, 96 and upper and lower slots 26 and 24, respectively, and legs 94, 96 are drawn together so that fingers 104 engage slots 110 and lock legs 94, 96 together. Living hinges 100 permit the hinging action of legs 94, 96 relative to female adapter 90. Middle louvre 32 can be included or omitted, depending on the user's taste. Likewise, cap 82 can be optionally omitted to provide up lighting.

Once the preferred configuration for bulb/lens assembly 12 is chosen, stake portion 22 is inserted into the ground. Then, of course, cable 18 must be connected to an appropriate low voltage power source, perhaps through or in conjunction with additional similar light fixtures 10.

Once the prong ends of elements 84 have pierced cable 18; assembly 12 is slid into engagement with assembly 14; and cable 18 is properly routed through stake assembly 14, assemblies 12 and 14 are truly locked together. Any attempt to slide assembly 12 off of post 14 is prevented by the elements 84 biting into cable 18, which in turn is firmly held in place by female adapter 90 in conjunction with apertures 26.

Figure 1:
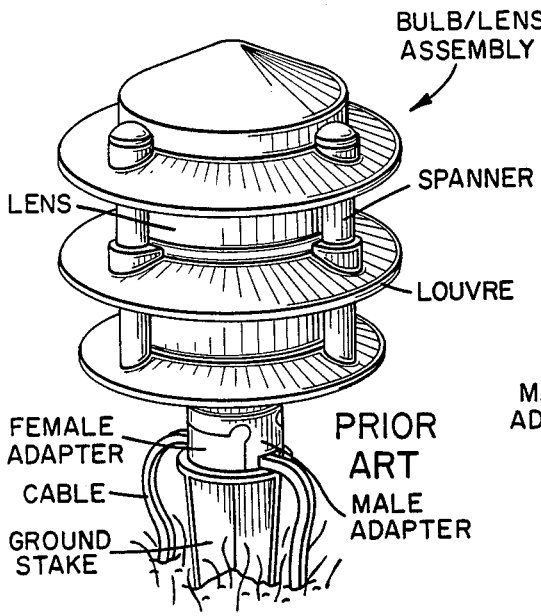
FIG. 1 is a perspective view of a prior art ground stake low voltage light fixture.
Figure 2:
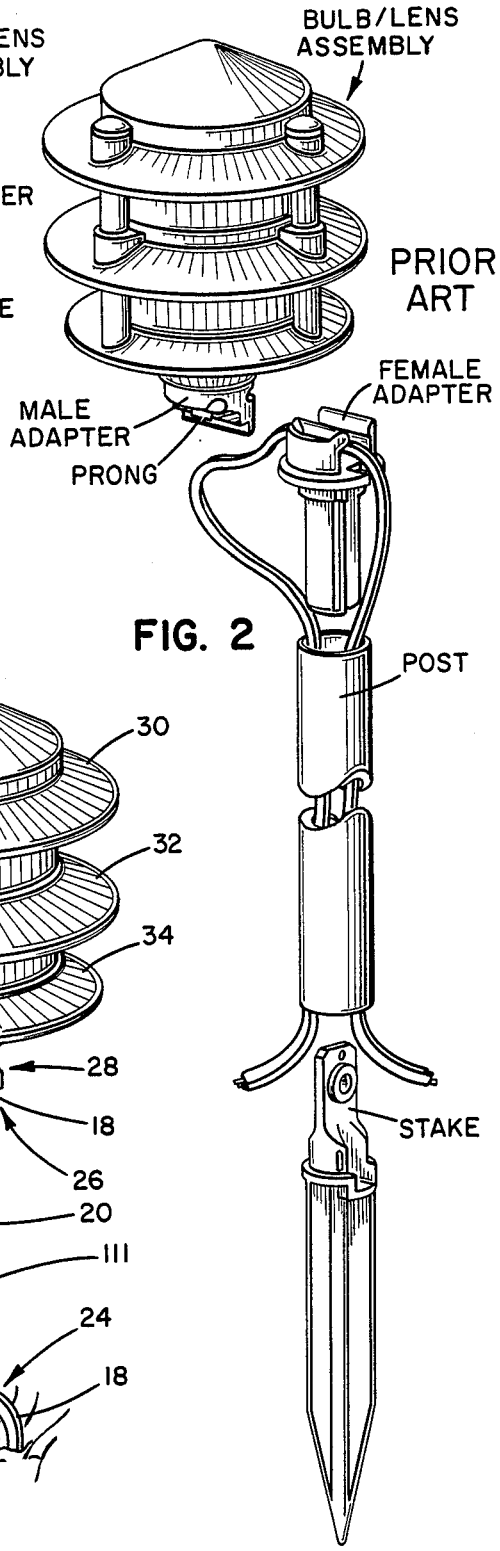
FIG. 2 is an exploded perspective view of another prior art low voltage light fixture including a post extender, wherein a portion of the male adapter is broken away to show one of the metal cable-puncturing prongs.

It should be noted that a minimum of cable slack is needed to attach fixture 10 to cable 18, unlike the prior art fixture of FIG. 2. This is because the female adapter 90 of fixture 10 is integral with post/stake assembly 14, unlike the separate female adapter of the FIG. 2 fixture.

Lens 16 is quite unlike traditional clear or translucent lenses. A clear non-fluted lens passes light directly, without reflection. Therefore, the bulb can be seen through the lens, causing a "hot spot." A translucent non-fluted lens helps alleviate hot spots, but markedly reduces the amount of light passing through the lens.

Ribs 114, 116 in lens 16 are specifically designed to allow lens 16 to transmit most of the light produced by bulb 68, while at the same time preventing hot spots. Triangular ribs 114, 116, and the associated grooves, reflect the light side-to-side so that the light is sufficiently scattered or diffused to prevent hot spots. Most of the light is indeed passed by lens 16, however, in contrast to the performance of translucent lenses.

A preferred embodiment of the invention is described above. Those skilled in the art will recognize that many embodiments are possible within the scope of the invention. Variations and modifications of the various parts and assemblies can certainly be made and still fall within the scope of the invention. Thus, the invention is limited only to the apparatus and method recited in the following claims, and equivalents thereto.

We claim:

1. A low voltage light fixture suitable for operatively holding a light source in spaced relation to a ground surface, comprising:

(a) means for operatively supporting the light source;

(b) means for attaching the fixture to the ground surface; and (c) elongate post means for spanning between the light source supporting means and the ground surface attaching means, wherein:

(i) the attaching means and post means comprise longitudinally-split elongate legs which are hingedly joined to the light source supporting means;

(ii) the light source is a bulb/lens assembly comprising means for holding an incandescent bulb and a lens surrounding the bulb;

(iii) the fixture is suitable for connecting to a cable and the bulb holding means comprises a pair of integral elements suitable for piercing the cable and supporting the bulb; and (iv) the bulb has a base and a pair of bulb leads, and wherein each integral element has a cable-piercing prong end and a bulb-receiving end comprising three leaves which springingly bear against the sides and one edge of the bulb base to hold the bulb and electrically contact one of the bulb leads.

* * * * *

UNITED STATES PATENT AND TRADEMARK OFFICE

CERTIFICATE OF CORRECTION

PATENT NO. : 4,774,648

DATED : September 27, 1988

INVENTOR(S) : Jay J. Kakuk et al.

It is certified that error appears in the above-identified patent and that said Letters Patent is hereby corrected as shown below:

On the title page, Item [75] delete "Robert W. Beachy, St. Paul,".

Signed and Sealed this

First Day of August, 1989

*Attest:*

*Attesting Officer*

DONALD J. QUIGG

*Commissioner of Patents and Trademarks*